United States Patent [19]

Yasutaniya

[11] Patent Number: 4,809,904

[45] Date of Patent: Mar. 7, 1989

[54] ENVELOPE ELEMENT, ENVELOPE BLANK AND ENVELOPE FORMED FROM THE ENVELOPE BLANK

[76] Inventor: Isamu Yasutaniya, 7-3, Nakamachi 4-chome, Houya-shi, Tokyo 202, Japan

[21] Appl. No.: 44,843

[22] PCT Filed: May 24, 1986

[86] PCT No.: PCT/JP86/00266

§ 371 Date: Mar. 5, 1987

§ 102(e) Date: Mar. 5, 1987

[87] PCT Pub. No.: WO87/00145

PCT Pub. Date: Jan. 15, 1987

[30] Foreign Application Priority Data

Jul. 9, 1985 [JP] Japan ..... 60-103522[U]

[51] Int. Cl.[4] ..... B65D 27/00

[52] U.S. Cl. ..... 229/68 R; 229/75; 229/110; 206/632

[58] Field of Search ..... 229/68 R, 75, 90, 41 C, 229/110; 206/632, 618

[56] References Cited

U.S. PATENT DOCUMENTS

| | | | |
|---|---|---|---|
| 3,726,469 | 4/1973 | Koehler | 229/110 |
| 3,873,017 | 3/1975 | Blatt | 229/41 C |
| 3,884,352 | 5/1975 | Pilz, III et al. | 229/110 |
| 4,065,047 | 12/1977 | Swan . | |
| 4,164,588 | 8/1979 | Johnson . | |
| 4,418,861 | 12/1983 | McFarland et al. | 229/41 C |
| 4,470,540 | 9/1984 | Koltz | 229/41 C |

FOREIGN PATENT DOCUMENTS

| | | |
|---|---|---|
| 676708 | 6/1939 | Fed. Rep. of Germany . |
| 38-8838 | 5/1963 | Japan . |
| 50-10619 | 2/1975 | Japan . |
| 50-25385 | 8/1975 | Japan . |
| 53-13774 | 12/1978 | Japan . |
| 55-21939 | 2/1980 | Japan . |
| 55-30853 | 7/1980 | Japan . |
| 263456 | 12/1949 | Switzerland . |
| 962181 | 7/1964 | United Kingdom . |
| 1002622 | 8/1965 | United Kingdom . |

*Primary Examiner*—Willis Little

*Attorney, Agent, or Firm*—Steinberg & Raskin

[57] ABSTRACT

An envelope element, and envelope blank and an envelope formed from the envelope blank, which is capable of protecting an article which is inserted therein against an impact imparted thereto from the outside, and obtaining an internal space therein in conformity with the shape of the article when it is inserted thereinto, and retaining the article stored stably therein. The envelope blank includes a cardboard having a relief portion, and has a front section having a pair of side edges and an end edge, and also a back section joined to the other end edge of the front section through a creasing line and also having a pair of side edges and an end edge. The portion which surrounds the creasing line is provided with relief portions.

14 Claims, 19 Drawing Sheets

ENVELOPE ELEMENT, ENVELOPE BLANK AND ENVELOPE FORMED FROM THE ENVELOPE BLANK

BACKGROUND OF THE INVENTION

The present invention relates to an envelope and an envelope element which are capable of protecting an article contained therein against an impact imparted thereto from the outside and an envelope which can readily extend its internal shape in conformity with the shape of an article and, more particularly, to an envelope and an envelope element which are formed by using a laminated cardboard.

Formerly, for a package bag for a heavy article, an envelope formed by using a two-layer laminated cardboard consisting of a flat cardboard and a corrugated cardboard adhered thereto, has been developed. In this prior art, a flat article such as a book and a magazine can be safely carried without any damage. However, when a brittle article made of glass or ceramics such as a bottle or an ashtray or a rigid article such as a tool is contained in such an envelope and carried, there are problems due to rigidity, insufficient buffer capability to guard against an impact, and so forth. Accordingly, it is difficult to contain such an article in the envelope readily and to carry it without any damage.

SUMMARY OF THE INVENTION

An object of the present invention is to provide an envelope and an envelope element which are capable of both readily containing an article regardless of its nature and form, and carrying and storing the article without any damage.

In accordance with an envelope and an envelope element according to the present invention, since an internal space thereof in conformity with a shape of an article to be contained is readily obtained and the contained article is held so it does not move while pressing the article, the article can be contained, carried and stored under quite stable conditions, and, since the envelope and the envelope element possess sufficient buffer capability to guard against an impact imparted thereto from the outside, the article contained therein can be effectively protected.

In one embodiment of the present invention, an envelope element consists of a cardboard including a relief portion having relief means.

In a preferred embodiment of the present invention, the relief means comprises a plurality of creasing lines, a cutout and a weak portion.

In another embodiment of the present invention, an envelope blank and an envelope formed from the envelope blank comprise a front section and a back section integrally connected thereto at its one end edge via a creasing line, and include a relief portion having relief means in a portion near the creasing line.

In a preferred embodiment of the present invention, the envelope blank consists of a laminated cardboard of at least three layers consisting of a pair of cardboards and a corrugated cardboard inserted therebetween.

In another preferred embodiment of the present invention, the front or the back section is formed with an end flap for sealing the envelope.

In still another preferred embodiment of the present invention, the front or the back section is formed with a side flap for sealing the side portion of the envelope.

In a preferred embodiment of the relief portion, the relief means comprises a creasing line having a line cut or a score line and a cutout.

Although the envelope blank consists of a cardboard in the preferred embodiments of the present invention, the envelope blank may consists of a nonwoven fabric or a synthetic resin material.

Although a part of the creasing lines are score lines in some embodiments of the present invention, the creasing lines may be simply pressed to form fold lines without making the score lines.

BRIEF DESCRIPTION OF THE DRAWINGS

The drawings illustrate embodiments of the present invention.

DESCRIPTION OF THE PREFERRED EMBODIMENTS

The present invention will now be described in detail taken in conjunction with the preferred embodiments thereof with reference to the accompanying drawings.

Figure 1:
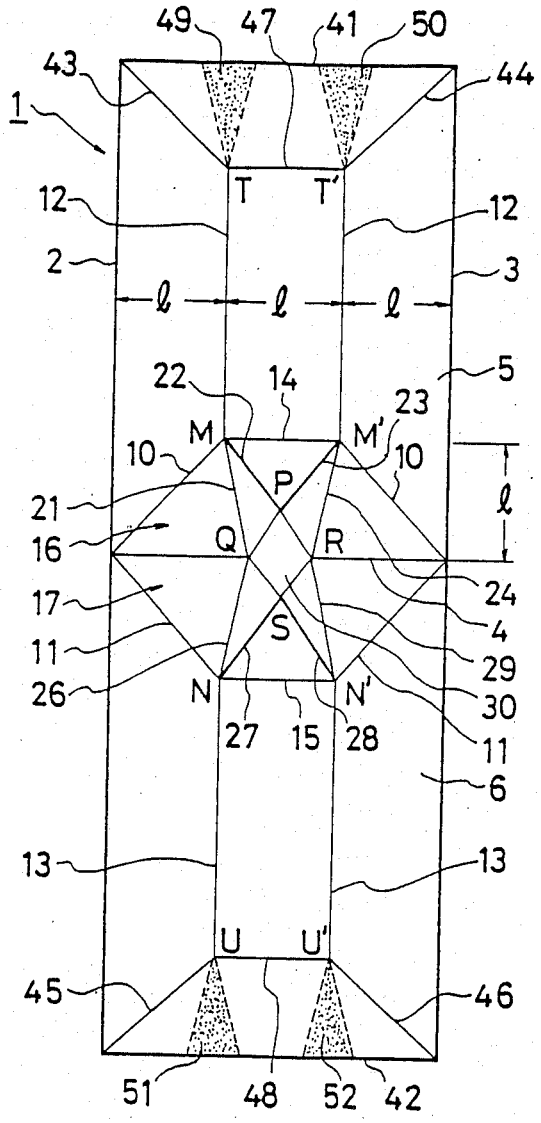
FIG. 1 is an elevational view, seen from inside, of an envelope blank according to the present invention.
Figure 2:
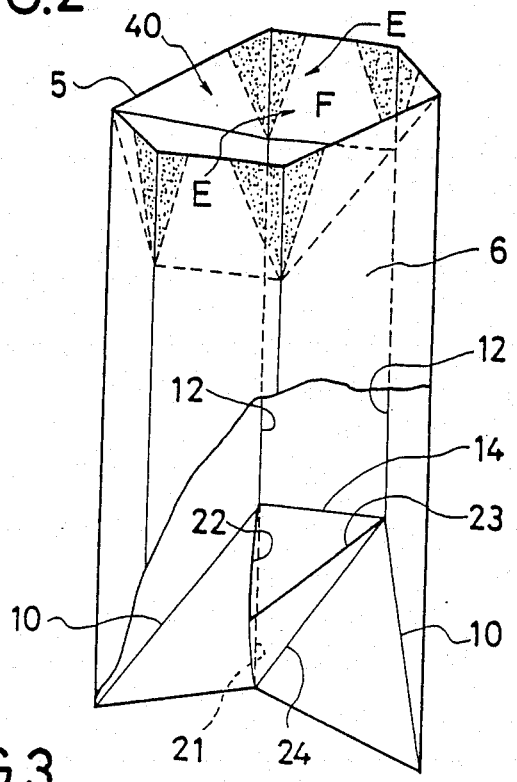
FIG. 2 is a perspective view, partly cutaway, of an envelope obtained by folding the envelope blank of FIG. 1.
Figure 3:
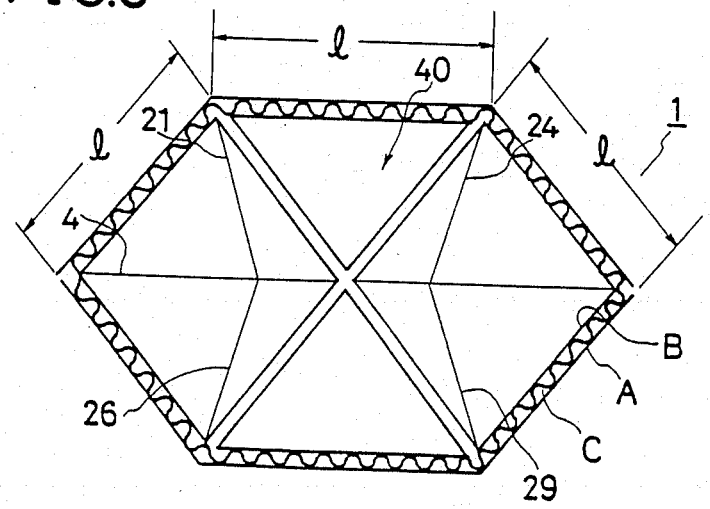
FIG. 3 is a top plan view of the envelope of FIG. 2.

In FIGS. 1–3, an envelope according to the present invention consists of a three-layer laminated cardboard (see FIG. 3) consisting of a pair of cardboards A and B and a corrugated cardboard C inserted therebetween, and convex and concave stripes of the corrugated cardboard C extend in the longitudinal direction of the envelope 1 substantially parallel with both side edges 2 and 3 thereof. The envelope 1 thus constructed from the cardboard is provided with a front section 5 and a back section 6 which are symmetrically coupled to each other via a creasing line 4 formed in substantially the central portion of the cardboard.

In a portion around the creasing line 4 constituting the connecting portion of the front section 5 and the back section 6 of the envelope 1, a first relief portion having relief means including lines cut or score lines is formed. That is, pairs of first slant creasing lines 10, 10 and 11, 11 for forming an inside space of the envelope are arranged and extend from both ends of the creasing line 4 along the border between the front section 5 and the back section 6, and a pair of parallel creasing lines 14 and 15, substantially parallel with the creasing line 4, connect the other ends M, M' and N, N' of the slant creasing lines 10, 10 and 11, 11, respectively. Further, pairs of second creasing lines 12, 12 and 13, 13 for forming the body of the envelope extend from the ends M, M' and N, N' of the first creasing lines 10, 10 and 11, 11 substantially in parallel with the side edges 2 and 3 of the envelope. When the envelope is assembled, the first creasing lines 10, 10 and 11, 11 are readily folded due to the presence of the second creasing lines 12, 12 and 13, 13.

Further, in order to fold the first slant creasing lines 10 and 11 and the second creasing lines 12 and 13 readily, a pair of reliefs 16 and 17 are formed via the creasing line 4 defining the border between the front section 5 and the back section 6. That is, one relief 16 is surrounded by the first slant creasing lines 10, 10, the horizontal creasing line 14 and the creasing line 4, and the other relief 17 is surrounded by the first slant creasing lines 11, 11, the horizontal creasing line 15 and the creasing line 4. Each relief 16 or 17 comprises a plurality of creasing lines formed on the inner surface of the assembled envelope and a rhombic cutout 30 formed in the central portion of the creasing line 4. The creasing lines formed on the inner surface of the front section 5 are four creasing lines 21, 22 23 and 24 connecting the ends M and M' of the first slant creasing lines 10, 10 and the vertices P, Q and R of the rhombic cutout 30. That is, the creasing line 21 is a creasing line having a segment MQ, the creasing line 22 is a line cut or score line having a segment MP in the cardboard B as shown in FIG. 3, the creasing line 23 is a score line having a segment M'P in the cardboard B, and the creasing line 24 is a creasing line having a segment M'R. The back section 6 is formed with four creasing lines 26, 27, 28 and 29 in a manner similar to those of the front section 5; that is, the two creasing lines 26 and 29 and the two score lines 27 and 28.

Then, the envelope is folded in two around the central creasing line 4 and the assembled envelope 1 is put into another envelope. Then, an article is put in an inside hollow space composed of the front section 5 and the back section 6 while the inside of the envelope 1 is extended so as to open it by folding the first creasing lines 10 and 11 and the second creasing lines 12 and 13 and the triangular area MM'P and SNN' arranged in the bottom portion of the envelope 1 are projected towards a top opening portion 40 of the envelope 1, as shown in FIG. 2. Accordingly, an article such as a bottle contained within the inside of the envelope 1, the bottom of the bottle being supported by the projected triangular areas, will, in the event it is dropped, be effectively protected from any damage.

On the other hand, in the top opening portion 40 opposite to the central creasing line 4, third slant creasing lines 43, 44, 45 and 46 connecting the ends T, T' and U, U' of the respective second creasing lines 12, 12 and 13, 13 and the opposite edges of the opposite free ends 41 and 42 of the front section 5 and the back section 6, and a pair of horizontal creasing lines 47 and 48 connecting the ends T, T' and U, U' of the second creasing lines 12, 12 and 13, 13, respectively, are formed. Further, in isosceles triangular small areas having respective vertexes T, T', U and U' of the second creasing lines 12, 12 and 13, 13 and base parts of the ends 41 and 42 of the envelope 1, many random perforations or dash cuts passing through the three-layer laminated cardboard are formed, thereby resulting in weak portions 49, 50, 51 and 52. These weak portions 49, 50, 51 and 52 and the creasing lines 43, 44, 45, 46, 47 and 48 function as a relief portion and thus constitute a second relief portion in the top opening portion 40, as compared with the first relief portion described above.

Hence, when the article is put into the envelope 1 which is then put into another conventional envelope and a cover is closed, a package having a fixed form can be readily obtained and such packages can be effectively and stably stored in a stack. Further, when the envelope 1 is designed as a right hexagonal cylinder having a side with a length 1, as shown in FIG. 3, the inside containing space of the envelope can be effectively used.

Figure 4:
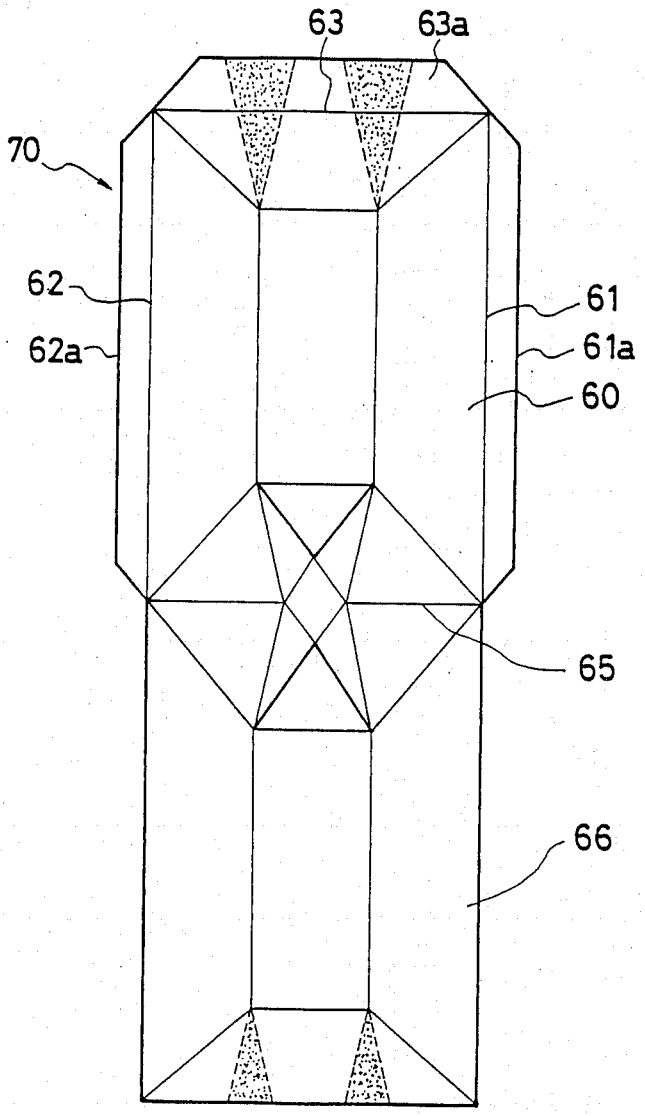
FIG. 4 is an elevational view of another envelope blank according to the present invention.

In FIG. 4, there is shown another embodiment of the present invention. The embodiment of FIG. 4 differs from the embodiment of FIG. 1 in that a pair of side flaps 61*a* and 62*a* are provided on a front section 60 via side creasing lines 61 and 62, and an end flap 63*a* is provided on the front section 60 via a creasing line 63 on its front end side opposite to a central creasing line 65 of an envelope 70.

In this embodiment, when the back section 66 is folded to the front section 60 through the creasing line 65 and the side flaps 61*a* and 62*a* are folded so as to adhere to the inside surface of the back section 66, the envelope 70 is sealed on its sides. Then, after putting an article into the envelope 70, the folded end flap 63*a* is stuck to the outer surface of the back section 66, and thus the envelope 70 is sealed.

In this case, the side flaps 61*a* and 62*a* and the end flap 63*a* may be provided on the back section 66. Alternatively, the side flaps 61*a* and 62*a* may be provided on the back section 66 and the end flap 63*a* may be provided on the front section 60.

Thus, when the envelope blank of the first embodiment shown in FIG. 1 is assembled, as shown in FIG. 2, an envelope having no sealed sides and no sealed end is obtained, but, when the envelope blank 70 of the second embodiment shown in FIG. 4 is assembled, as shown in FIG. 2, an envelope having sealed sides and a sealed end can be obtained.

In any embodiment, the opening portion 40 of the envelope assembled as shown in FIG. 2 may be closed by using another means (the embodiment of FIG. 1) or the end flap 63*a* (the embodiment of FIG. 4).

Figure 5:
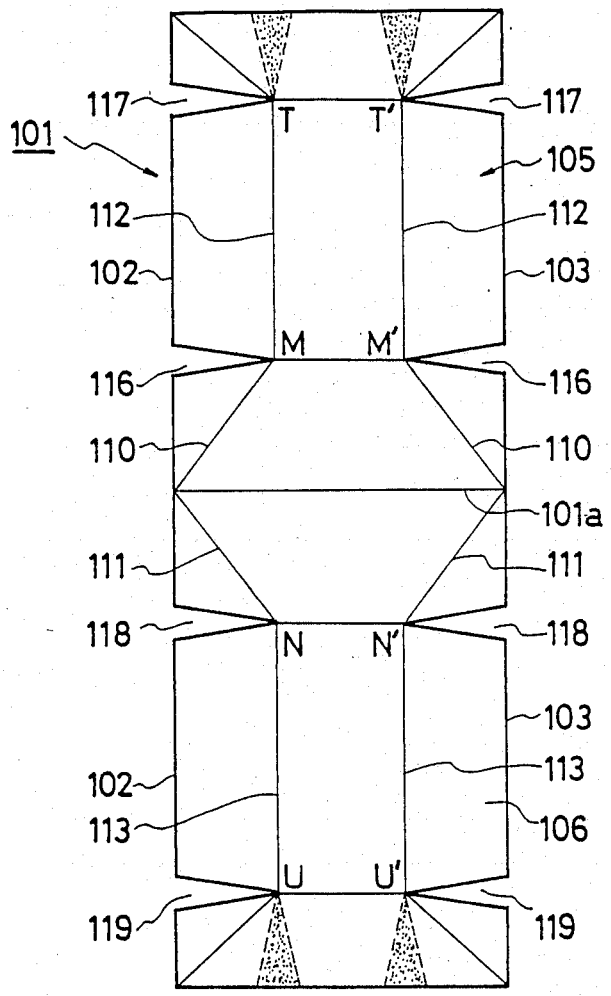
FIG. 5 and FIG. 6 show still another embodiment of the present invention, FIG. 5 being an elevational view, seen from inside, of an envelope blank and FIG. 6 being a perspective view of an envelope assembled by folding the envelope blank of FIG. 5.
Figure 6:
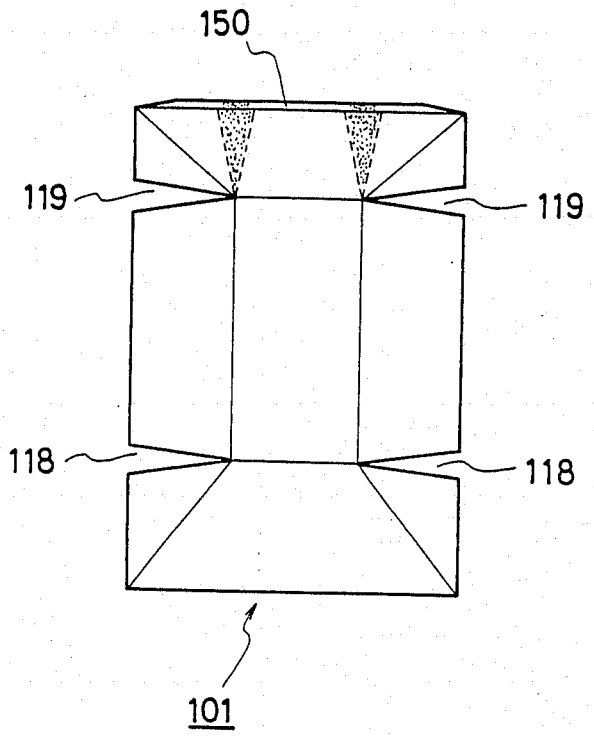

In FIGS. 5 and 6, there is shown still another embodiment of the present invention. In this embodiment, an envelope 101 comprising a front section 105 and a back section 106 is symmetrically provided with first slant creasing lines 110, 110 and 111, 111 and second creasing lines 112, 112 and 113, 113 on the inner surfaces of the front and the back sections 105 and 106 via a central creasing line 101*a* in the same manner as the previous embodiments, except that reliefs contributing to the easy folding of the first creasing lines and the second creasing lines when an article containing space 150 is formed, and reliefs for enabling an cover to close are formed in the front section 105 and the back section 106. That is, pairs of reliefs 116, 117, 118 and 119 having substantially the same acute vertical angle cutouts are formed, and the reliefs 116 and 117 of the front section 105 are symmetrical to the reliefs 118 and 119 of the back section 106 with respect to the central creasing line 101*a*. The reliefs 116 are triangular cutouts having vertices M and M' of the intersections of the first slant creasing lines 110, 110 and the second creasing lines 112, 112, and base parts of side end edges 102 and 103 of the envelope 101, and the reliefs 117 positioned in a higher position than the reliefs 116 are triangular cutouts of substantially the same form thereof, having vertices T and T' of the ends of the second creasing lines 112, 112, and the base parts of the side end edges 102 and 103. The back section 106 is formed with pairs of the reliefs 118, 118 and 119, 119 having the vertices N, N' and U, U' of the opposite ends of the second creasing lines 113, 113 in the same manner as the front section 105.

Then the article is put in the article containing space 150 of the envelope 101 and the envelope 101 is put into another envelope having a little larger size than the envelope 101. On this occasion, the first creasing lines and the second creasing lines are readily folded to form the article containing space. At this time, the cutouts are closed, and hence, even when an impact is imparted to the envelope from the outside, the article contained therein can be effectively protected.

Figure 7:
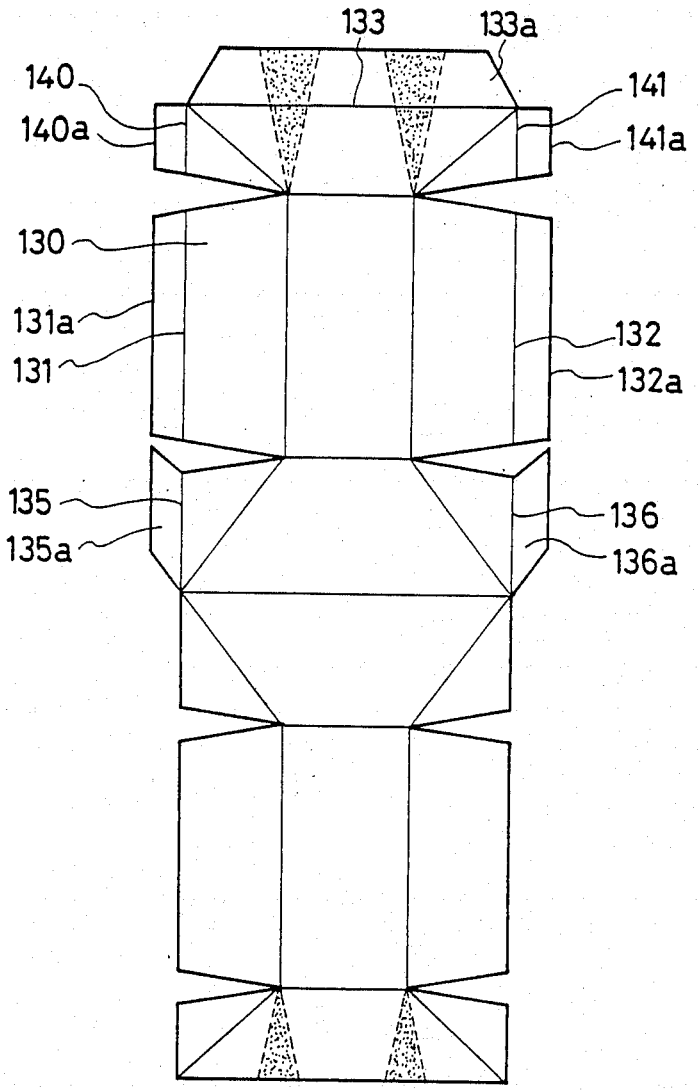
FIGS. 7–9 show other embodiments of an envelope blank, seen from inside, according to the present invention.
Figure 8:
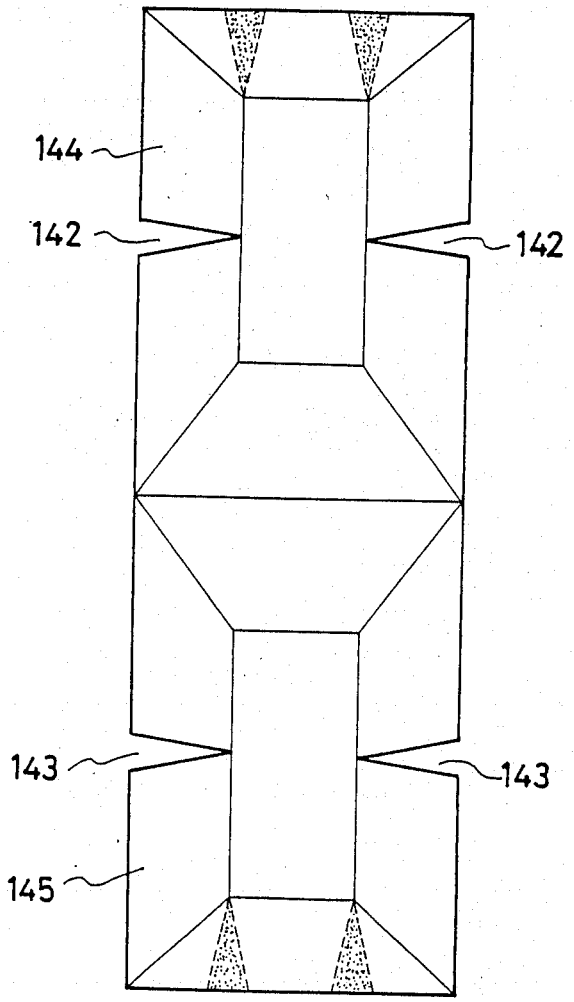
Figure 9:
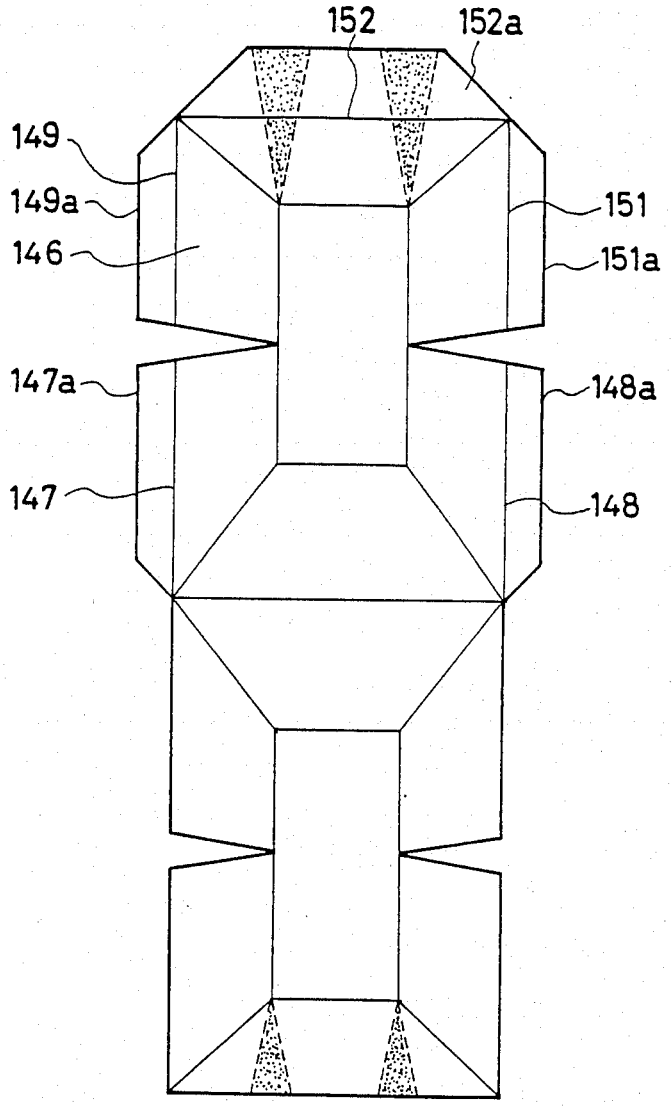
Figure 10:
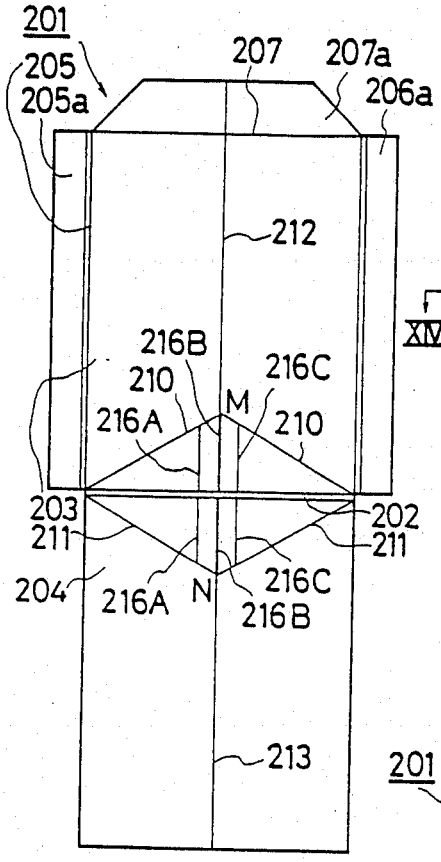
FIG. 10 is an elevational view of still another embodiment of an envelope blank according to the present invention.
Figure 11:
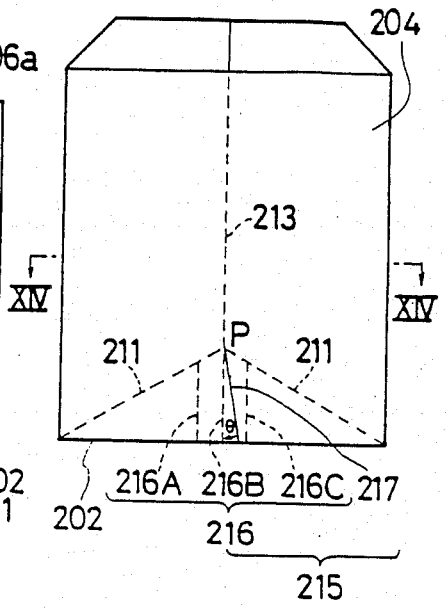
FIG. 11 is a back view of an envelope assembled by folding the envelope blank of FIG. 10.
Figure 12:
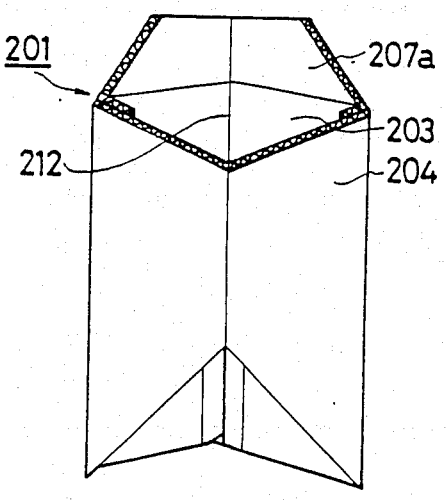
FIG. 12 is a perspective view of the envelope of FIG. 11, of which the inside is extended open.

In FIGS. 7–9, there are shown modifications of the embodiment of FIG. 5. In the embodiment of FIG. 7, the front section 130 is formed with side flaps 131*a*, 132*a*, 135*a*, 136*a*, 140*a* and 141*a* via creasing lines 131, 132, 135, 136, 140 and 141, and an end flap 133*a* via a creasing line 133.

In the embodiment of FIG. 8, the front section 144 and the back section 145 are each formed with pairs of reliefs of triangular cutouts 142, 142 and 143, 143, respectively, in the central portions in the longitudinal direction of the front and the back sections, and the other portions are the same as those of the embodiment of FIG. 5.

In the embodiment of FIG. 9, a front section 146 is formed with side flaps 147*a*, 148*a*, 149*a* and 151*a* via creasing lines 147, 148, 149 and 151, and an end flap 152*a* via a creasing line 152.

In the embodiments described above, although the first and the second creasing lines are formed on the inner surfaces of the envelope, they may be formed on the outer surfaces of the envelope, or be formed on both the inner and the outer surfaces of the envelope.

Further, in the embodiments of the envelopes having the side and the end flaps, when an adhesive is attached to the flaps in advance, the assembling of the envelopes may be readily and quickly carried out.

Furthermore, although the front section and the back section are symmetrically connected to each other with reference to the central creasing line of the lower end of the front section, the back section may be connected to the side edge of the front section or upper end edge thereof via a side or upper end creasing line.

Instead of the reliefs in the form of the cutouts of FIG. 5, FIG. 6, FIG. 7, FIG. 8 and FIG. 9, the weak portions described in connection with the embodiment of FIG. 1 may be formed in the cutout portions, and it is confirmed that the same function as the relief means may be obtained.

In FIGS. 10–15, a further embodiment of the present invention is shown. In FIGS. 10–13, an envelope 201 consists of the three-layer laminated cardboard consisting of a pair of cardboards A and B and a corrugated cardboard C interposed therebetween, in the same manner as the aforementioned embodiments (refer FIG. 14). In this embodiment, although the laminated cardboard is used so that the convex and the concave stripes of the corrugated cardboard C may extend substantially parallel with both the sides of the envelope 201, the laminated cardboard may be so used that the strips may extend perpendicular to both the sides of the envelope 201. The envelope 201 formed from such a cardboard is provided with a front section 203, a back section 204 integrally connected thereto via a central creasing line 202, a pair of side flaps 205*a* and 206*a* integrally connected to both sides of the front section 203 via side creasing lines 205 and 206, and an end flap 207*a* integrally connected to the free end of the front section 203 via an end creasing line 207.

On the inner surfaces of the front section 203 and the back section 204 of the envelope 201, pairs of first slant creasing lines 210, 210 and 211, 211 which extend from the ends of the central creasing line 202 are formed for extending the inside bottom portion of the envelope 201 when using the assembled envelope 201, and a pair of second creasing lines 212 and 213 which extend from the intersections M and N of the first slant creasing lines 210, 210 and 211, 211 to the free ends of the front section 203 and the back section 204 substantially parallel with the sides of the envelope 201 are formed for widening the inside body portion of the envelope 201 when using the assembled envelope 201. The first slant creasing lines 210 and 211 can be readily folded due to the presence of the second creasing lines 212 and 213.

Figure 22A:
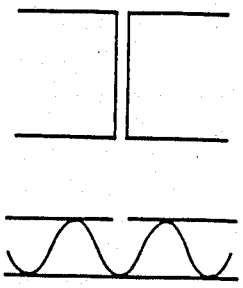
FIGS. 22A–22F show embodiments of creasing lines formed on inner sides of the envelopes of the present invention.
Figure 22B:
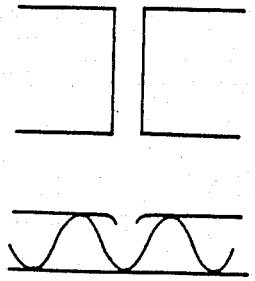
Figure 22C:
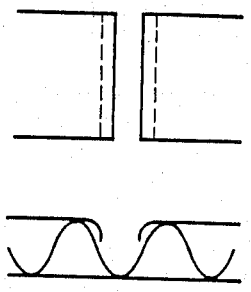
Figure 22D:
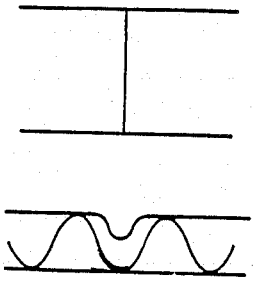
Figure 22E:
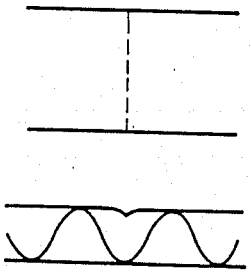
Figure 22F:
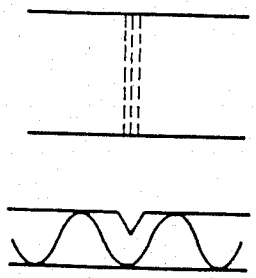

Further, reliefs 215 defined by the first slant creasing lines 210, 210 and 211, 211 and the central creasing lines 202 for promoting the folding of the first creasing lines 210 and 211 and the second creasing lines 212 and 213 are provided on the front section 203 and the back section 204. The reliefs 215 comprise creasing lines 216 formed on the inner surfaces of the front section 203 and the back section 204, and creasing lines 217 formed on the outer surfaces thereof. That is, each creasing line 216 consists of a central score line 216B and a pair of creasing lines 216A and 216C arranged in both the sides thereof, these three lines 216A, 216B and 216C extending from the central creasing line 202 to the first creasing lines 210, 210 or 211, 211 substantially in parallel with both the side ends of the front section 203 and the back section 204. Each creasing line 217 formed on the outer surface of the envelope 201 is inclined at an acute angle $\theta$ and extends from a point P positioned on the other side of the intersection M or N of the first creasing lines, i.e., the outer surface of the front section 203 or the back section 204, to the central creasing line 202. In the embodiments of the present invention, a score line is a line cut as exemplified in FIG. 22A, FIG. 22B and FIG. 22C, and a creasing line is a line with a pressed concave portion as illustrated in FIG. 22D, FIG. 22E and FIG. 22F. In FIGS. 22A–22F, the upper figures are elevational views of the score line or the creasing line and the lower figures are longitudinal cross sectional views of the upper figures.

Figure 13:
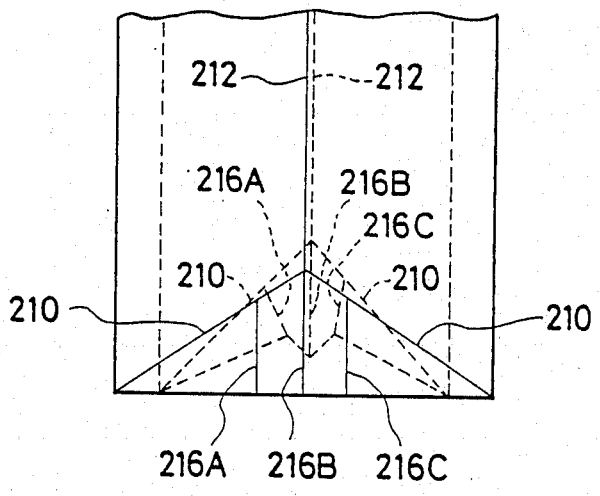
FIG. 13 is an enlarged fragmentary view of the envelope of FIG. 11 showing an essential part of its inside.
Figure 14:
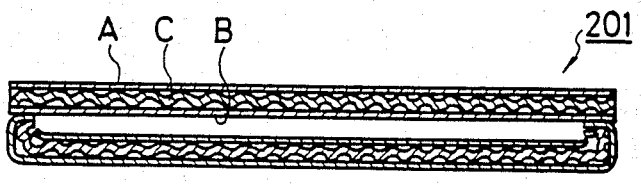
FIG. 14 is an enlarged transverse cross sectional view, taken along the line XIV—XIV of FIG. 11.

Then, when the inside of the assembled envelope 201 is widened by folding the first creasing lines 210 and 211 and the second creasing lines 212 and 213, the inner lower end portions of the front and the back sections of the assembled envelope 201 are projected in inversed V-shaped forms towards the opposed inner surfaces, as shown in FIG. 13. Accordingly, when an article such as a bottle is contained within the assembled envelop 201, the bottom of the bottle is supported by the projected lower end portions of the envelope 201, thereby protecting the bottle from impact damage. As to the relief means, the small isosceles triangular areas having the vertex point P shown in FIG. 11 and the base part of the central creasing line 202 may be formed with many random perforations or dash cuts passing through the laminated cardboard, as shown in the embodiment of FIG. 1, so as to form the weak portions of the relief portion.

Figure 15:
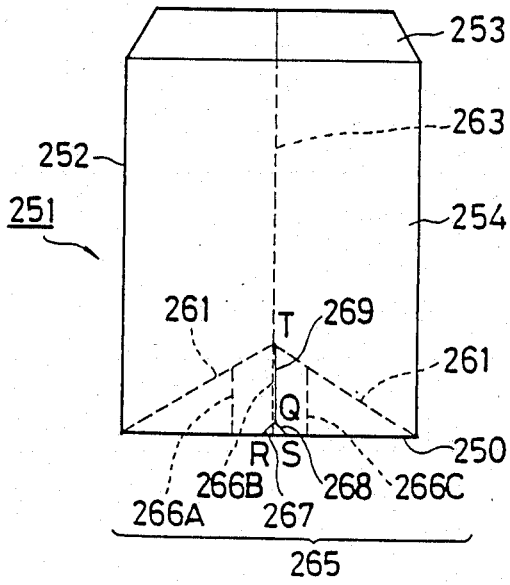
FIG. 15 and FIG. 16 illustrate another embodiment of an envelope according to the present invention, FIG. 15 being a back view thereof, FIG. 16A being an enlarged back view of its bottom portion and FIG. 16B being an enlarged fragmentary front view of its bottom portion.
Figure 16A:
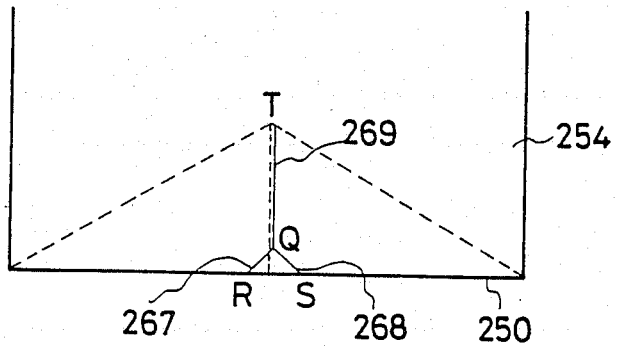
Figure 16B:
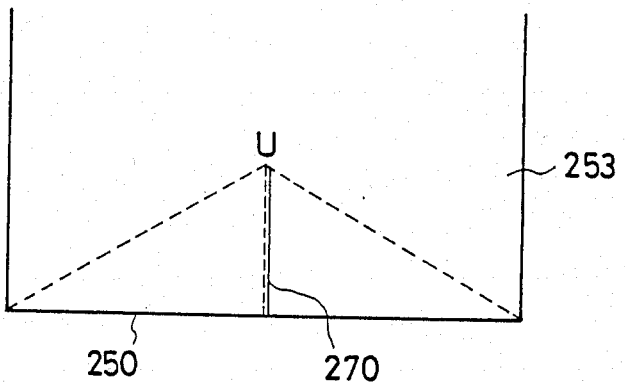

Further, in FIGS. 15, 16A and 16B, there is shown another embodiment of the present invention. In this embodiment, an envelope 251 is formed with pairs of first slant creasing lines 261, 261 and a pair of second creasing lines 263 on its inner surface (creasing lines formed on an inner surface of a front section are not shown) in the same manner as the embodiment of FIG. 10, except that a relief 265 for assisting the folding of the first and the second creasing lines comprises three score lines 266A, 266B and 266C formed on the inner surfaces of the front section 253 and the back section 254 substantially in parallel with both the sides of the envelope 251, two creasing lines 267 and 268 defining a small triangle QRS with a vertex point Q on the outer surface of the back section 254, a creasing line 269 extending from the point Q to the point T on the outer surface of the back section 254, and another creasing line 270 extending from a point U positioned on the other side of the front section 253 in a symmetrical position of the point T to a central creasing line 250.

Figure 17:
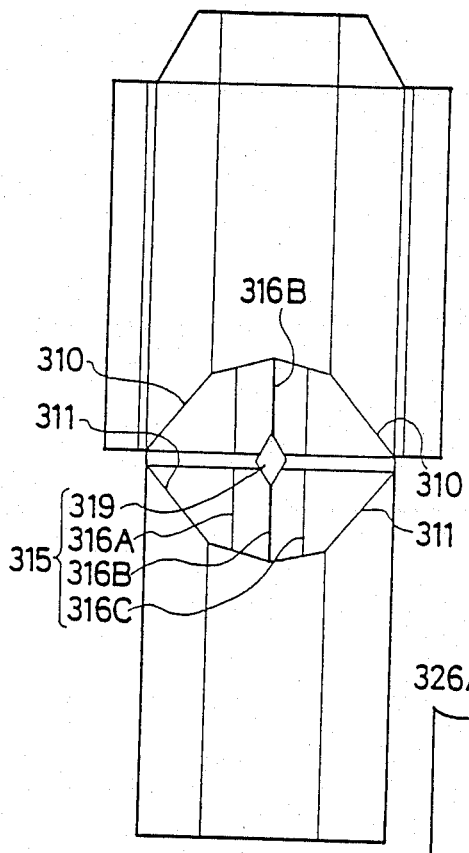
FIGS. 17–19 show still other embodiments of the present invention, FIG. 17 showing another envelope blank, FIG. 18 being a rear view of an envelope formed from the envelope blank of FIG. 17 and FIG. 19 schematically showing a modification of a relief means of FIG. 17.
Figure 18:
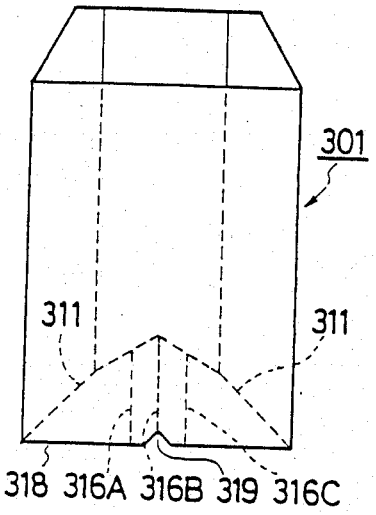
Figure 19:
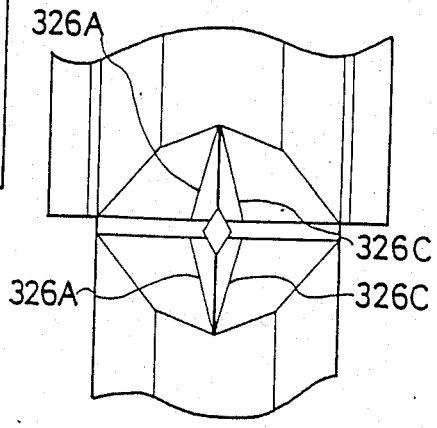
Figure 20:
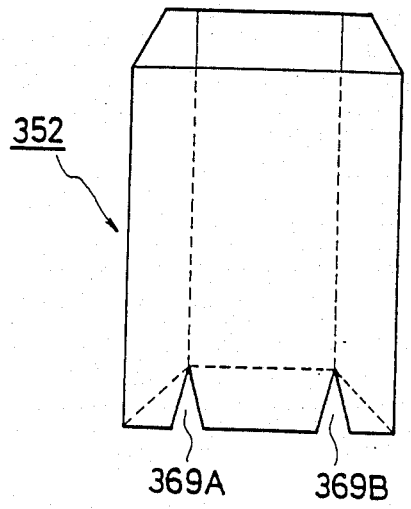
FIG. 20 and FIGS. 21A–21C show other embodiments of cutouts of other envelopes formed according to the present invention.
Figure 21A:
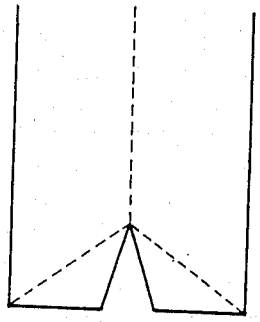
Figure 21B:
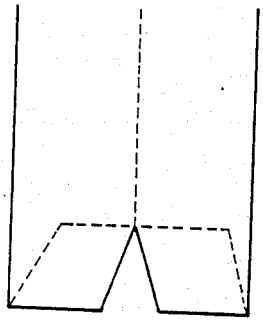
Figure 21C:
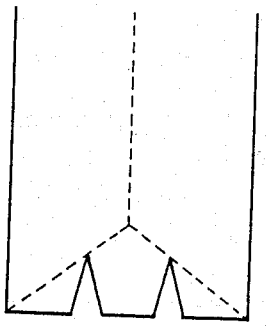
Figure 23A:
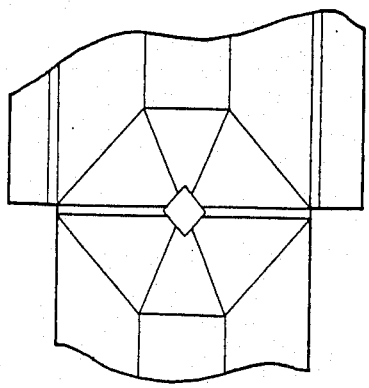
FIG. 23A and FIG. 23B partially show still another embodiment of an envelope blank according to the present invention, FIG. 23A showing a bottom portion thereof, seen from the outer side and FIG. 23B showing the same portion, seen from the inner side.
Figure 23B:
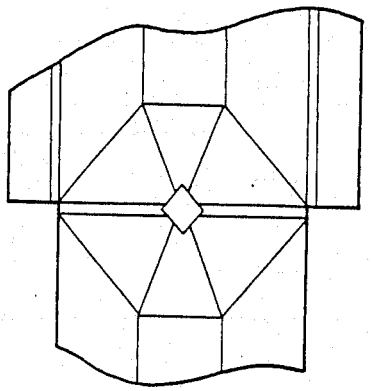

Further, in FIGS. 17–19, there is shown still another embodiment of the present invention. In this embodiment, an envelope 301 has the same construction as the above described embodiment, except that pairs of first creasing lines 310, 310 and 311, 311 are formed for assisting the widening of a body portion of the envelope when using the assembled envelope 301, as shown in the figures, and a relief means 315 comprises parallel creasing lines 316A, 316C, score lines 316B and a rhombic cutout 319 formed substantially in a central portion of a central creasing line 318. The small rhombic cutout 319 of the assembled envelope 301 is usually closed by pressure due to the thickness of the material of the envelope 301, but the small rhombic cutout 319 effectively contributes to the extension of the inside space of the assembled envelope. When the bottom portion of the assembled envelope is widened, the small rhombic cutout 319 is completely closed. The parallel creasing lines 316A and 316C may be replaced by the slant creasing lines 326A and 326C shown in FIG. 19. Instead of the small rhombic cutout 319, two cutouts 369A and 369B having a little larger size than the cutout 319 may be formed, as shown in FIG. 20. In this embodiment, an envelope 352 is preferably provided with pairs of second creasing lines on the inner surfaces of front and back sections thereof, as shown in FIG. 20. When the size of the cutouts is properly determined in advance depending on the thickness of the cardboard, the cutouts may be completely closed after putting the article into the envelope. Modifications of a combination of the cutout and the first creasing lines are illustrated in FIG. 21A–FIG. 21C. In addition, depending on the selection of the cardboard material, the cutout or cutouts may be omitted. Although the first creasing lines and the second creasing lines are formed on the inner surface of the envelope in these embodiments, in a manner similar to the previously described embodiments, the first and the second creasing lines may be formed only on the outer surface of the envelope or on both the inner and the outer surfaces of the envelope, as shown in FIGS. 23A and 23B.

As for the cardboard material, in addition to the three-layer laminated cardboard, a multi-layer laminated cardboard such as a five-layer laminated cardboard obtained by adding a further corrugated cardboard and a flat cardboard to the three-layer laminated cardboard may also be used for an envelope, depending on its uses.

In FIGS. 24–31, there are shown embodiments of an envelope element and an envelope having the envelope elements according to the present invention.

Figure 24:
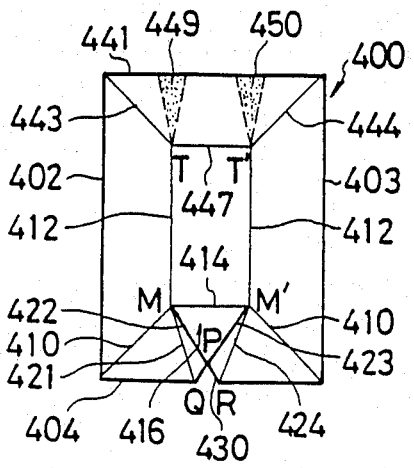
FIG. 24 is an elevational view of another embodiment of an envelope element according to the present invention.

In FIG. 24, an envelope element 400 according to the present invention is formed from the same three-layer laminated cardboard as that of the above described embodiments, and the convex and the concave stripes of the corrugated cardboard of the laminated cardboard extend substantially parallel with both side edges 402 and 403 of the envelope element 400. The envelope element 400 thus formed from such a laminated cardboard is formed with a relief portion including relief means having score lines and creasing lines and so forth. That is, the envelope element 400 is formed with a pair of first slant creasing lines 410, 410 extending from opposite ends of a lower end 404, and a horizontal creasing line 414 connecting the ends M and M', of the first creasing lines 410, 410 substantially in parallel with the lower end 404. A pair of second creasing lines 412, 412 extend upwards from the ends M and M' of the first creasing lines 410, 410 substantially parallel with both the side end edges 402 and 403 of the envelope element 400.

Further, the envelope element 400 is provided with a relief portion 416 defined by the first creasing lines 410, 410, the horizontal creasing line 414 and the lower end 404. The relief portion 416 comprises a plurality of creasing lines and score lines formed on the outer surface layer of the three-layer laminated cardboard, and a triangular cutout 430 formed in the central portion of the lower end 404. That is, the creasing lines of the envelope element 400 are four creasing lines 421, 422, 423 and 424 which extend from the ends M and M' of the first creasing lines 410, 410 to the vertices PQR of the triangular cutout 430, and the two creasing lines 422 and 423 are score lines.

On the other hand, near an upper end 441 of the envelope element 400, a pair of third slant creasing lines 443 and 444 extend from the other ends T and T' of the second creasing lines 412, 412 to the opposite edges of the upper end 441, and a horizontal creasing line 447 extends between the ends T and T' of the second creasing lines 412, 412. Further, a pair of small isosceles triangular areas having respective vertexes T and T' and base parts of the upper end 441 are formed with a large number of perforations or dash cuts passing through the three-layer laminated cardboard so as to obtain weak portions 449 and 450. The weak portions 449 and 450 and the creasing lines 443, 444 and 447 together function as a relief means and hence constitute a relief portion near the upper end 441 of the envelope element 400, along with the above described relief portion 416 in the lower portion of the envelope element 400.

Therefore, when an article is contained in the envelope element 400 and the envelope element 400 is put in another conventional envelope and a cover is closed, the article contained can be retained in a quite stable state.

Figure 25:
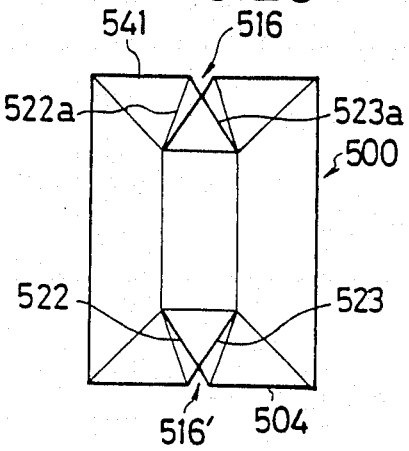
FIG. 25 is an elevational view of still another embodiment of an envelope element according to the present invention.

In FIG. 25, there is shown another embodiment of an envelope element according to the present invention. In this embodiment, an envelope element 500 has a similar construction to that of the embodiment of FIG. 24, except that a pair of relief portions 516 and 516' having the same construction as the relief portion 416 of the embodiment of FIG. 24 are formed in portions of upper and lower ends 541 and 504 of the envelope element 500. In this embodiment of FIG. 25, creasing lines **522*a*, 523*a*, 522 and 523** are formed as score lines, each having a cutting line in an outer surface layer of a three-layer laminated cardboard.

Figure 26:
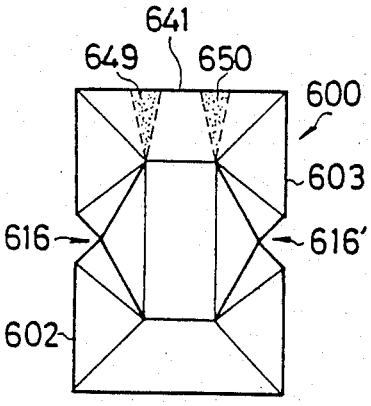
FIG. 26 is an elevational view of a further embodiment of an envelope element according to the present invention.

Further, as shown in FIG. 26 in a further embodiment according to the present invention, an envelope element 600 possesses a construction similar to that of the embodiment of FIG. 25, except that a pair of relief portions 616 and 616' having structures similar to those of the embodiment of FIG. 25 are formed in central portions of both sides 602 and 603 of the envelope element 600, and that a pair of weak portions 649 and 650 having the same constructions as those of the embodiment of FIG. 24 are formed in a portion near an upper end 641 of the envelope element 600.

Figure 27:
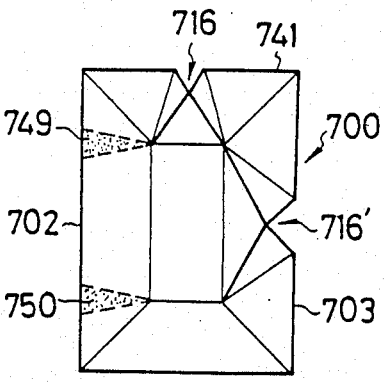
FIG. 27 is a still further embodiment of an envelope element according to the present invention.

Further, in still another embodiment of the envelope element according to the present invention of FIG. 27, an envelope element 700 is formed with relief portions 716 and 716' having the same constructions as those of the aforementioned embodiments in portions of an upper end 741 and a right side 703, and a pair of weak portions 749 and 750 having constructions similar to those of the embodiment of FIG. 24 in a portion of a left side 702.

When the envelope elements 400, 500, 600 and 700 of the above embodiments are used, a pair of envelope elements are put in a conventional envelope and an article is put between the envelope elements in order to advantageously protect the article. When a pair of envelope elements are inserted into the conventional envelope, the same two envelope elements or two different envelope elements may be put into the usual envelope depending on the form and the kind of article to be contained.

Figure 28:
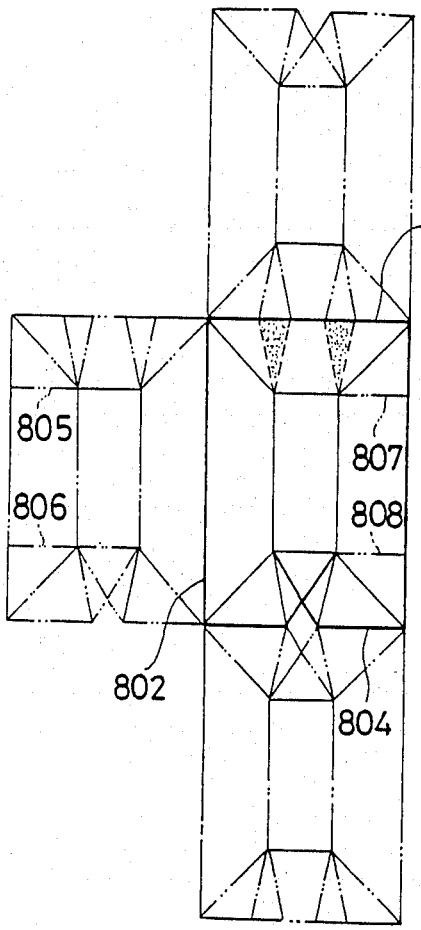
FIGS. 28–31 schematically show some embodiments of envelopes formed by assembling envelope elements according to the present invention.
Figure 29:
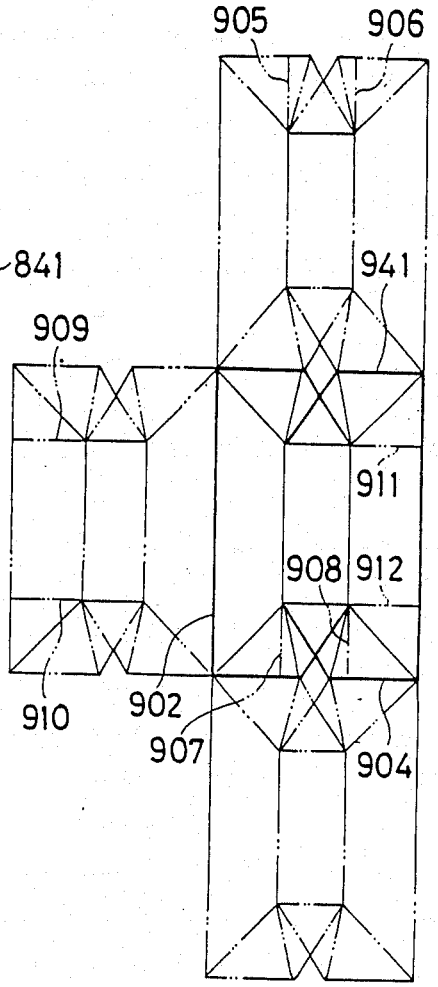

In FIGS. 28–29, there are shown embodiments of an envelope consisting of envelope elements according to the present invention. As shown in FIG. 28, when the two envelope elements shown in FIG. 24 are symmetrically coupled to each other via a creasing line at an upper end 841, one side 802 or a lower end 804 of one of the envelope elements, an envelope as described in one of the above embodiments will be obtained. For instance, when two envelope elements are coupled via the creasing line at the lower end 804, the envelope of the embodiment shown in FIG. 1 is obtained.

Similarly, as shown by the imaginary lines of FIG. 29, when the two envelope elements shown in FIG. 25 are symmetrically coupled to each other via a creasing line at an upper end 941, one side 902 or a lower end 904 of one of the envelope elements, an envelope of the present invention will be obtained.

Figure 31:
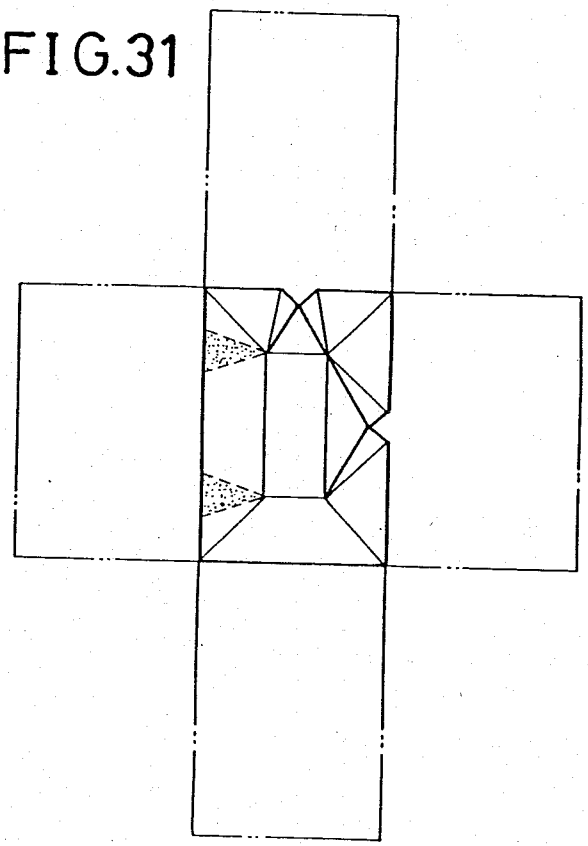
Figure 30:
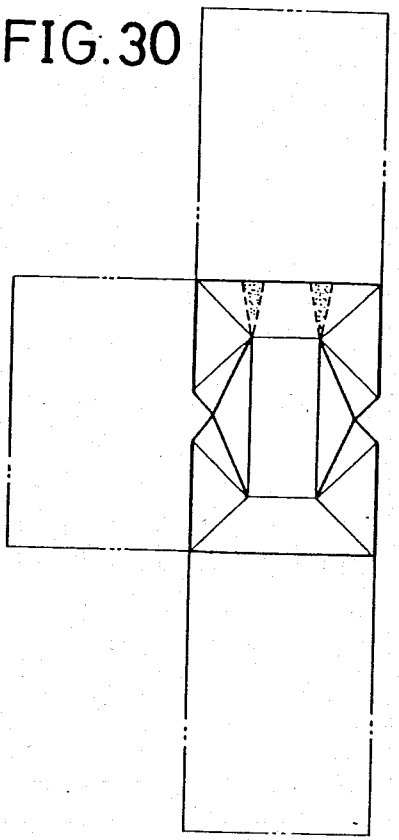

Further, in FIGS. 30–31, as schematically shown by imaginary lines thereof, when the two envelope elements of FIG. 26 or FIG. 27 are symmetrically connected to each other via a creasing line at an upper end, one side or a lower end of one of the envelope elements, an envelope of the present invention will be obtained. From these figures, it is readily understood that various changes and modifications of the envelope may be possible according to the present invention.

Further, in the examples of the coupling of the envelope elements shown in FIG. 28, when the two envelope elements are coupled to each other via a creasing line at the one side 802, more creasing lines 805, 806, 807 and 808 may be formed depending on the size of the article to be contained and the uses of the envelope. Similarly, in FIG. 29, when the two envelope elements are connected to each other via a creasing line at the upper end 941, more creasing lines 905, 906, 907 and 908 may be formed, and, further, when the two envelope elements are coupled to each other via a creasing line at the one side 902, more creasing lines 909, 910, 911 and 912 may be formed.

An envelope element and an envelope according to the present invention will give superior protection to an article contained therein against an impact imparted thereto from the outside, and on putting the article in the envelope of the present invention, the internal space of the envelope is readily extended in conformity with the shape of the article. Further, when the article is contained within the envelope, the article is stably held by virtue of the storing capability of the envelope so it does not move, and hence, as opposed to the case of a conventional box, there is no need to stuff filling in its inside. Further, when a formless article is contained within the envelope, the external shape of the envelope becomes a fixed form, and therefore the efficiency of packing, storing and transmitting operations can be greatly increased. In addition, more efficient use of work area and storage area space will be made possible.

I claim:

1. An envelope blank comprising:

a front section having a pair of side edges and a pair of end edges and a back section having a pair of side edges and a pair of end edges which is integrally coupled to one end of the front section via a central creasing line and a first relief portion having first relief means being formed in a portion surrounding the central creasing line, said first relief means having pairs of first creasing lines for forming an inside space of the envelope arranged and extended from both ends of the central creasing line and a pair of parallel creasing lines substantially parallel with the central creasing line which connect the other ends of the first creasing lines, pairs of second creasing lines for forming the body of the envelope being extended from said other ends of the first creasing line substantially in parallel with the side edges of the envelope, said second relief portions having second relief means cooperating with said second creasing lines being arranged in symmetrical portions in the front section and the back section; and at least one cutout cooperating with at least one of the first and the second relief means and being substantially formed in symmetrical positions in the front and back sections.

2. An envelope blank as defined in claim 1, wherein the first relief means includes third creasing lines connecting the central creasing line and the second creasing lines.

3. An envelope blank as defined in claim 2, wherein the first relief means includes a cutout formed on the central creasing line.

4. An envelope blank as defined in claim 3, wherein the second creasing lines, the third creasing lines and the cutouts are arranged in symmetrical positions in the front section and the back section.

5. An envelope blank as defined in claim 2, wherein the third creasing lines include a score line.

6. An envelope blank as defined in claim 2, wherein the blank is formed from a laminated cardboard of at least three layers having a pair of cardboards and a corrugated cardboard interposed therebetween.

7. An envelope blank as defined in claim 1, wherein the second relief means include creasing lines and weak portions formed on the front section and the back section.

8. An envelope blank as defined in claim 7, additionally comprising a plurality of cutouts cooperating with the first and the second relief means and being substantially formed in the symmetrical positions in the front section and the back section in their side portions.

9. An envelope blank as defined in claim 1, wherein the relief means include additional creasing lines provided on the front section and the back section on the opposite surface of the third creasing lines.

10. An envelope blank as defined in claim 1, wherein an end flap is provided on either the front or the back section, and a pair of side flaps are provided on either the front or the back section.

11. An envelope blank of claim 1 wherein the back section is coupled to the end of the front section in an inwardly bent state.

12. An envelope as defined in claim 11, wherein a side flap provided on either the front or the back section is stuck to the other section.

13. An envelope element as defined in claim 1, wherein the creasing lines include score lines.

14. An envelope blank comprising a front section having a pair of side edges and a pair of end edges and a back section having a pair of side edges and a pair of end edges which is integrally coupled to one of the front section via a central creasing line and a first relief portion having first relief means being formed in a portion surrounding the central creasing line, said relief means having pairs of first creasing lines for forming an inside space of the envelope arranged and extended from both ends of the central creasing line, and a pair of parallel creasing lines substantially parallel with the central creasing line which connect the other ends of the first creasing lines, pairs of second creasing lines for forming the body of the envelope which extend from said other ends of the first creasing lines substantially in parallel with the side edges of the envelope, said first creasing lines being readily folded due to the presence of the second creasing lines and both said first creasing lines and second creasing lines being readily folded due to a pair of reliefs formed via the central creasing line, one relief being surrounded by a first pair of first creasing lines, a first parallel creasing line and the central creasing line and the other relief being surrounded by a second pair of first creasing lines, a second parallel creasing line and the central creasing line, each of said reliefs comprising a plurality of creasing lines formed on the inner surface of the assembled envelope with a rhombic cutout formed in a central portion of the central creasing line, said plurality of creasing lines being formed on both the inner surface of the front section, so as to connect first other ends of the first creasing lines and first vertices of the rhombic cutout, and on the inner surface of the back section so as to connect second other ends of the first creasing lines and second vertices of the rhombic cutout, said envelope being folded in two around the central creasing line and insides of the envelope extended so as to open the same by folding the first creasing lines and the second creasing lines, whereby triangular areas arranged in a bottom portion of the envelope are projected towards a top opening of the envelope, said triangular areas providing support for a bottom of an article contained inside a hollow space of composed of the front section and back section.

* * * * *